US006808426B2

(12) United States Patent
Liu

(10) Patent No.: US 6,808,426 B2
(45) Date of Patent: Oct. 26, 2004

(54) STRUCTURE OF A SIGNAL ADAPTER

(75) Inventor: Kun-Hung Liu, Taipei Hsien (TW)

(73) Assignee: Ai Ti Ya Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 10/392,818

(22) Filed: Mar. 21, 2003

(65) Prior Publication Data

US 2004/0185720 A1 Sep. 23, 2004

(51) Int. Cl.[7] ..... H01R 25/00
(52) U.S. Cl. ..... 439/654; 439/578
(58) Field of Search ..... 439/63, 638, 578, 439/584, 628, 654, 944

(56) References Cited

U.S. PATENT DOCUMENTS 5,649,837 A * 7/1997 Arnold ..... 439/557
5,863,226 A * 1/1999 Lan et al. ..... 439/852
5,993,254 A * 11/1999 Pitschi et al. ..... 439/584
6,227,868 B1 * 5/2001 Wlodarski ..... 439/63

* cited by examiner

*Primary Examiner*—Tho D. Ta
*Assistant Examiner*—James R. Harvey

(57) ABSTRACT

A structure of a signal adapter is disclosed. The signal adapter of the present invention comprises an adapter and a fitting head. The adapter comprises a receiving portion, and a space is formed within the receiving portion. The space comprises an indented circular buckling groove. A flat face is formed close to the flange of the circular buckling groove and a guiding portion is formed on the other side thereof. The fitting head comprises a fitting plate, which has a guiding portion, and a flat face is formed at the bottom flange of the fitting plate. A tube is positioned in the center of the fitting plate, wherein the tube is for fitting a fitting element. Clamping portions are integrally formed on the two sides of the fitting element. The clamping portions comprise a plurality of hollow resilient elements that become gradually narrower towards the center.

11 Claims, 5 Drawing Sheets

STRUCTURE OF A SIGNAL ADAPTER

BACKGROUND OF THE INVENTION

1. The Field of the Invention

The present invention relates to a structure of the signal adapter, and more particularly relates to a adapter comprising a receiving portion with a space, wherein the space has a circular buckling groove there-within, and a fitting head of the signal adapter having a fitting plate inlayed into the space of the circular buckling groove, for positioning, easy assembly and secure fastening. The signal adapter of the present invention can be manufactured at a lower cost.

2. Description of the Related Art

Referring to FIGS. 5, 6 and 7, while assembling the conventional signal adapters the user has to use tools to fit the isolation tube A into the hollow portion B1 of the adapter B, and a fitting element C is for fitting into said isolation tube A. However, the isolation tube A is unable to substantially cover the fitting element C tightly thus it causes inconvenience during assembly and adversely affecting the signal transmission. Furthermore, the fitting element C within the adapter B provides a clamping force for holding the conducting wire D1 of the clamping signal wire D and a conducting path for the signal transmission, however because the clamping area of such fitting element C and the conducting wire D1 is too small, the fitting element C can be easily oxidized and gets damaged by the external force causing poor connection. Besides, the conventional skill is to fit isolation tube A into the hollow portion B1 of the adapter B, but however the isolation tube A can easily get dislodged after several fitting operation due to lack of firmed structure. The adapter B has a tilt arch-shaped distal end for forming only one single contact point for the connection of the adapter B and the clamping signal wire D, and thus this structure can easily cause the oxidation, signal leakage or disassociated wave to further cause poor signal transmission. Accordingly, it is highly desirable to overcome the above defects in order to improve the signal transmission of the signal adapter.

SUMMARY OF THE INVENTION

Accordingly, in the view of the foregoing, the present inventors make a detailed study of related art to evaluate and consider, and uses years of accumulated experience in this field, and through several experiments, to create a new structure of a signal adapter. The present invention provides an innovated signal adapter to effectively simplify the assembly, reduce oxidation of the contact surfaces so that the aforementioned problems of the prior art can be effectively resolved.

According to one aspect of the present invention, a circular buckling groove is provided within a space of a receiving portion of the adapter. The receiving portion comprises a fitting head having a fitting plate, wherein the fitting plate of the fitting head is for buckling into the circular buckling groove for positioning and preventing the fitting head from slipping out.

According to another aspect of the present invention, a fitting element is provided within the tube of the fitting head, wherein the fitting head can be pushed into the space formed at the receiving portion of the adapter for forming an ideal closed cover with better fitting, and therefore the oxidation of the fitting element which would otherwise cause short circuit due to the oxidized fitting element can be effectively avoided. Further, this structure will also effectively prevent tilting, deformation or lose contact by the external force. Further, the signal adapter of the present invention can be manufactured at a lower cost.

According to another aspect of the present invention, the adapter is flat, and therefore the contact area can be substantially increased when the preset clamping signal wire is connected with the adapter so that the contact area can be rendered waterproof or moisture proof, and therefore reducing generating the disassociated wave.

BRIEF DESCRIPTION OF THE DRAWINGS

For a more complete understanding of the present invention, reference, will now be made to the following detailed description of preferred embodiments taken in conjunction with the accompanying drawings, in which.

DETAILED DESCRIPTION OF THE PREFERRED EMBODIMENTS

Figure 1:
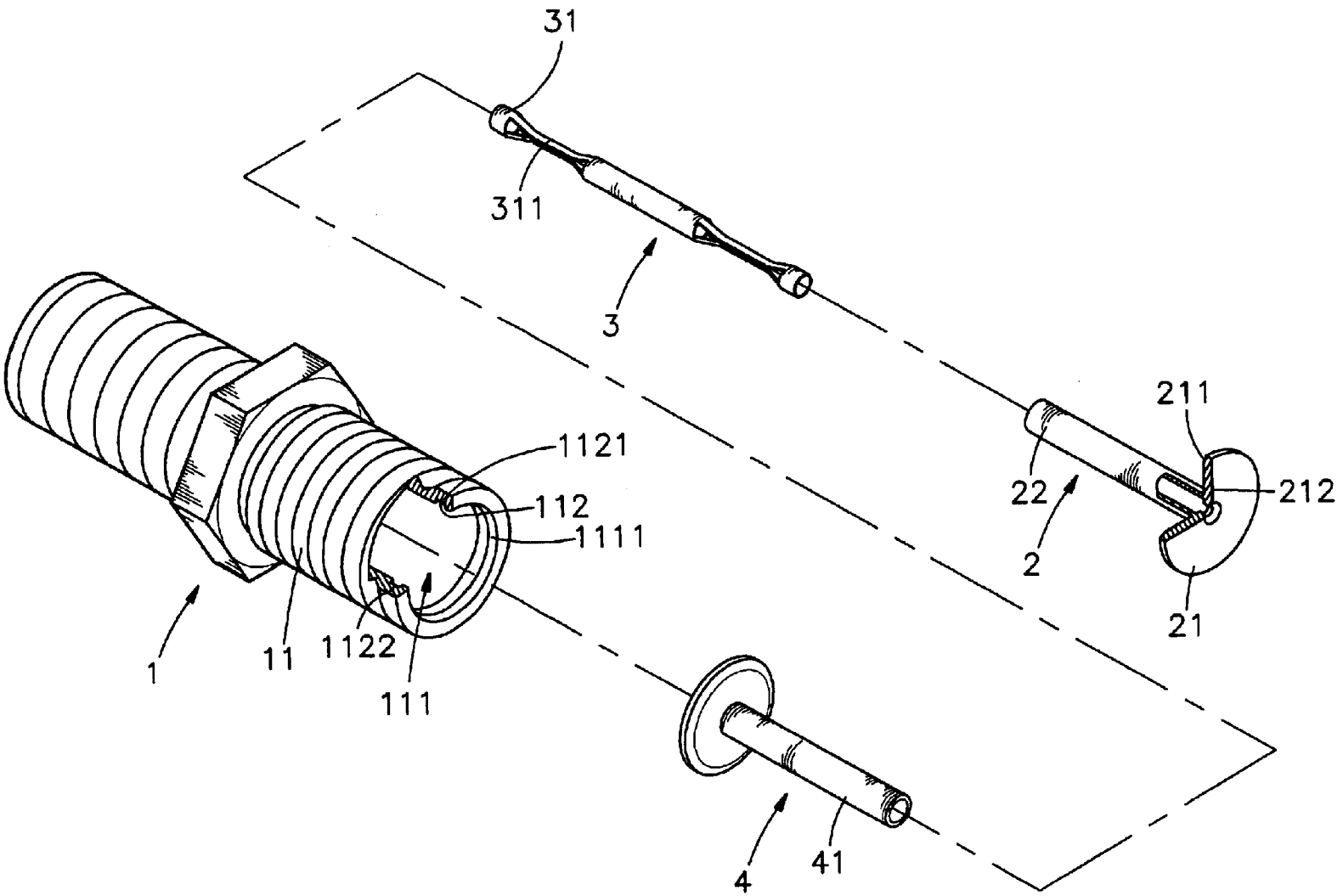
FIG. 1 is an exploded view of a structure of a signal adapter of the present invention.

Reference will be made in detail to the preferred embodiments of the invention, examples of which are illustrated in the accompanying drawings. Wherever possible, the same reference numbers are used in the drawings and the description to refer to the same or like parts.

Referring to FIG. 1, the signal adapter of the present invention comprises an adapter 1 and a fitting head 2. The adapter 1 comprises a receiving portion 11, and a space 111 is formed within the receiving portion 11. The space 111 comprises an indented circular buckling groove 112. A flat face 1121 is formed close to the flange of the circular buckling groove 112 and a guiding portion 1122 is formed on the other side thereof. Further, a guiding portion 1111 is formed at an edge of the space 111.

The fitting head 2 comprises a fitting plate 21, which has a guiding portion 211, and a flat face 212 is formed at the bottom flange of the fitting plate 21. A tube 22 is positioned in a central region of the fitting plate 21, wherein the tube 22 is for fitting a fitting element 3. Clamping portions 31 arm integrally formed on the two sides of the fitting element 3. Each of the clamping portions 31 comprise a hollow resilient element comprised of three resilient clamping elements 311 wherein the inner diameter of the hollow resilient element become gradually narrower towards the center.

Figure 2:
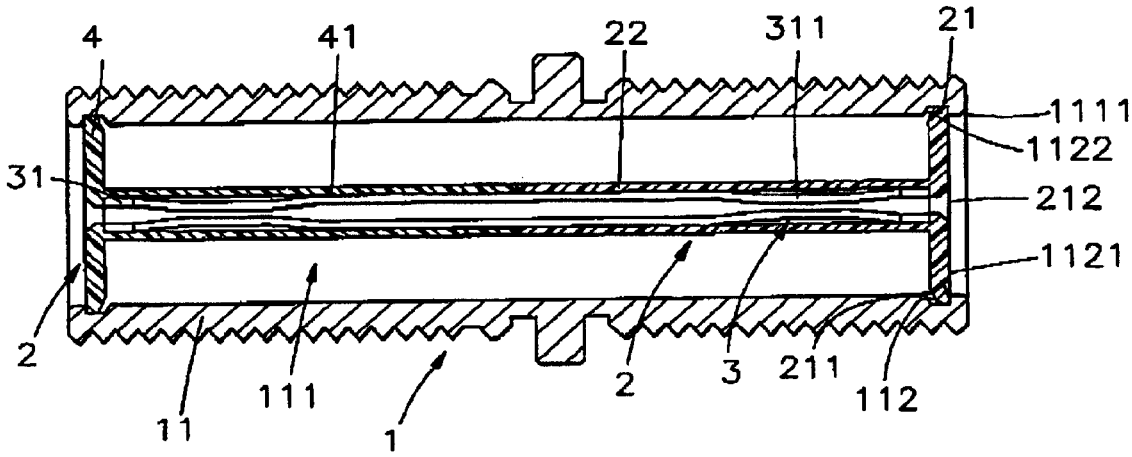
FIG. 2 is a sectional side view of the structure of the signal adapter after the assembly of the signal adapter of the present invention.
Figure 3:
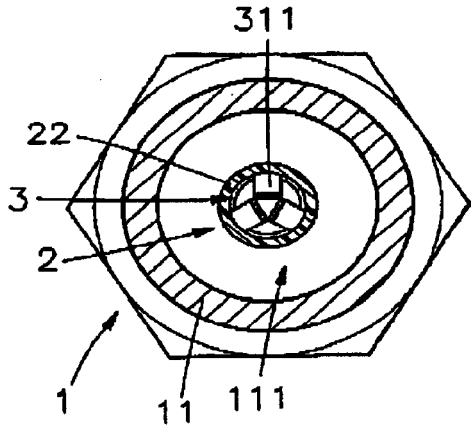
FIG. 3 is a sectional frontal view of the structure of the signal adapter after the assembly of the signal adapter of the present invention.

Referring to FIGS. 2 and 3, the application of the signal adapter of the present invention will be described. For example, one of the clamping portions 31 of the fitting element 3 of a F-81 adapter is fitted into the tube 22 of the fitting head 2. The other clamping portions 31 of the fitting element 3 are fitted into the tube 41 of the other fitting head 4, which has smaller dimension. Then the fitting head 4, which is of a smaller dimension, is pushed directly into the space 111 formed at the receiving portion 11 of the adapter 1. The fitting head 2 comprises a fitting plate 21, and the fitting plate 21 is located a guiding portion 211 supporting the guiding portion 1111, which is formed close to the flange of the space 111. When the user uses a tool to apply force inwardly, the fitting plate 21 of the fitting head 2 will be pressed into the circular buckling groove 112, which is positioned inside of the space 111, to make the flat face 212 formed at the bottom edge of the fitting plate 21 of the fitting head 2 supported on the flat face 1121 of the circular buckling groove 21 to clamp into position securely. Further, the user can fit the signal wire (not shown) into the fitting element 3, in doing so, the hollow resilient elements 311 are propped opened by the signal wire and the signal wire gets tightly secured.

Figure 4:
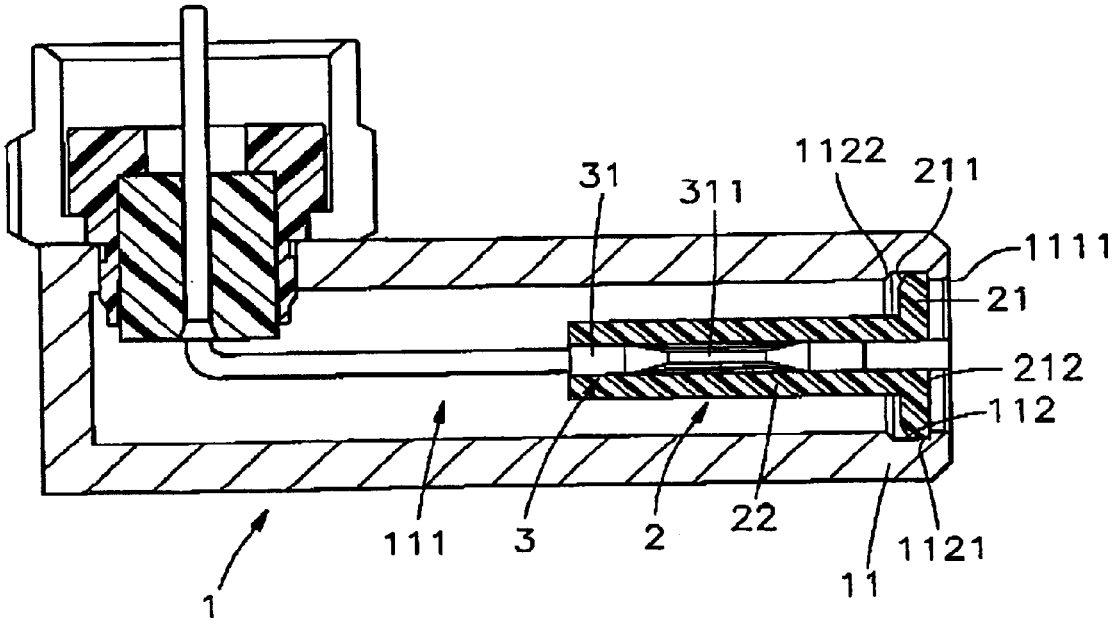
FIG. 4 is a sectional side view of the preferred embodiment of the structure of the signal adapter of the present invention.
Figure 5:
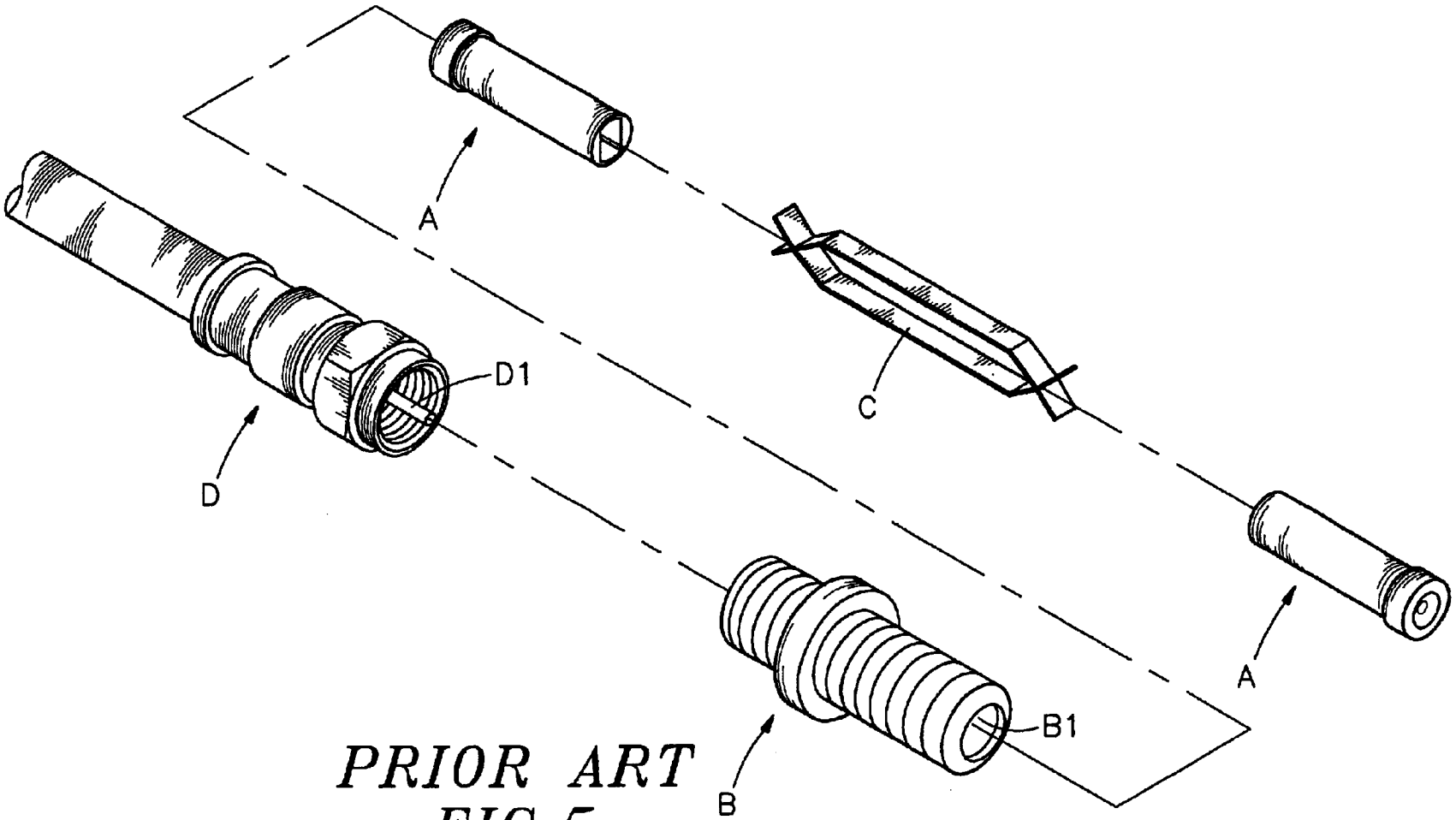
PRIOR ART FIG. 5
FIG. 5 is an exploded view of a structure of a conventional signal adapter.
Figure 6:
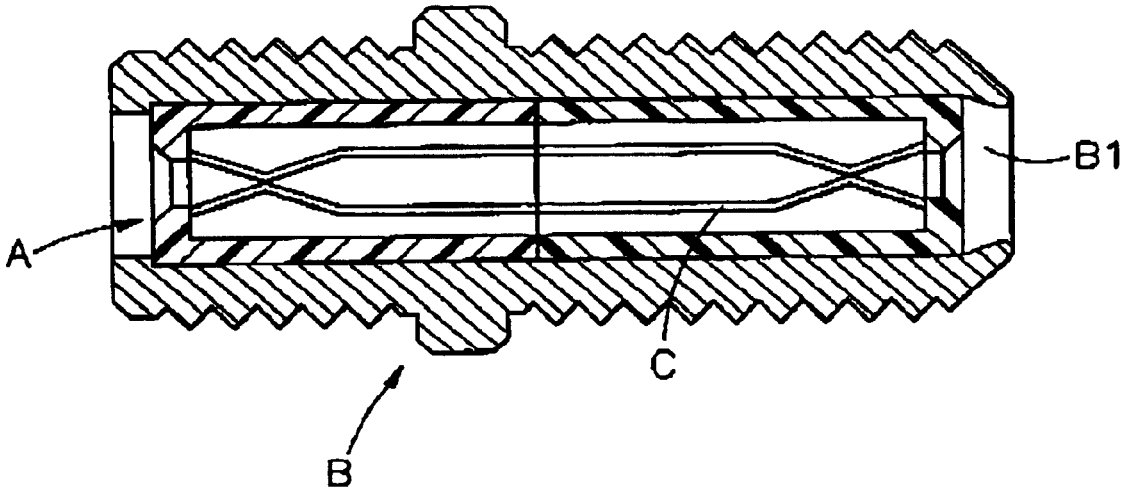
PRIOR ART FIG. 6
FIG. 6 is a sectional side view of the structure of the conventional signal adapter.
Figure 7:
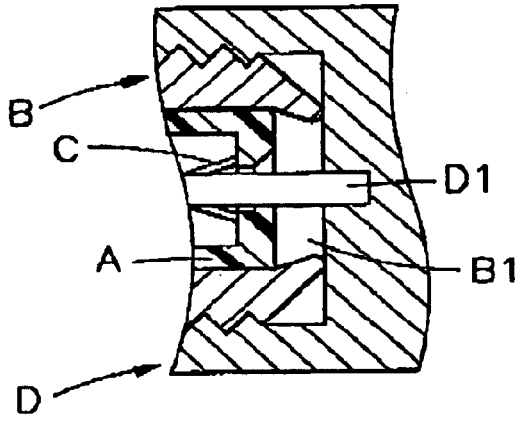
PRIOR ART FIG. 7
FIG. 7 is a sectional side view showing the application of the conventional signal adapter.

Referring to FIG. 4, the teachings of the present invention is not only applied to F-81 adapter but also can be applied to a common-axle cable adapter. Only manual operation and simple tool required for assembling the signal adapter of the present invention. Therefore, the signal adapter of the present invention is not only manufactured at low cost but also requires no extra tools for the assembly of the signal adapter. Thus the secure positioning and substantial coverage of the fitting element are the primary features of the present invention.

Furthermore, the fitting element 3 of the present invention has been modified compared to the conventional fitting element, which essentially comprises four pieces of the resilient elements, in that the fitting element 3 of the signal adapter of the present invention has only three pieces of the hollow resilient elements 311. Thus the inner dimension of the clamping portion 31 can be further reduced to increase the clamping area with the conducting wire to improve the electrical features, for example, insertion damage and reflection damage, can be improved exceeding the existing high frequency standard. Advantageously, the clamping and pulling stress of the conducting wire can be further improved compared to the conventional four-piece resilient element, as the two tubes 22 of the fitting head 2 covers the fitting element 3 tightly to effectively reduce the outer interference. Furthermore, since the shape of the adapter 1 of the signal adapter of the present invention is flat, therefore this could provide an increased contact area with signal wire, thus the waterproof ability can be improved to effectively reduce generation of the disassociated wave.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What the invention claimed is:

1. A structure of a signal adaptor, comprising:

an adaptor comprising a receiving portion, wherein said receiving portion has a space formed there-within, said space of the receiving portion comprising a circular buckling groove disposed at one end portion of said adaptor; and a fitting clement having a first clamping portion, a second clamping portion and a central portion between said first and second clamping portions, positioned in said space within said receiving portion;

a first fitting head comprising a first fitting plate and a first tube positioned at a central region of said first fitting plate for receiving said first clamping portion of said fitting element;

a second fitting head comprising a second fitting plate and a second tube is positioned at a central region of said second fitting plate for receiving said second clamping portion of said fitting element, wherein said first and second tubes extend up to said central portion of said fitting element, and wherein said second fitting plate is for fitting into said circular buckling groove of said space.

2. The structure of the signal adapter according to claim 1, wherein a guiding portion is formed at an edge of said space.

3. The structure of the signal adapter according to claim 2, wherein said circular buckling groove comprises a flat face, formed adjacent to the guiding portion and a guiding face on the other side thereof.

4. The structure of the signal adapter according to claim 1, wherein said second fitting plate of the second fitting head comprises a guiding face, and at the bottom edge of said second fitting plate comprises a flat face.

5. The structure of the signal adapter according to claim 1, wherein each of said first and second clamping portions of said fitting element comprises a hollow resilient element comprised of three resilient clamping element, and wherein an inner diameter of said hollow resilient element become narrower gradually towards center thereof.

6. The structure of the signal adapter according to claim 1, wherein said adapter is comprised of a common-axle cable adapter.

7. A structure of a signal adapter, comprising:

an adapter comprising a receiving portion, wherein said receiving portion has a space formed there-within, said space of the receiving portion comprising a circular buckling groove disposed at one end portion of said adaptor; and a fitting element having a hollow resilient element comprised of three resilient clamping elements, positioned within said space of said receiving portion;

a fitting head comprising a fitting plate a tube positioned at a central region of said fitting plate for receiving said fitting element, wherein said fitting plate is for fitting into said circular buckling groove of said space, and wherein said fitting plate of the fitting head comprises a guiding face, and at the bottom edge of said fitting plate comprises a flat face.

8. The structure of the signal adapter according to claim 7, wherein a guiding portion is formed at an edge of said space.

9. The structure of the signal adapter according to claim 7, wherein said circular buckling groove comprises a flat face formed adjacent to the guiding portion, and a guiding face on the other side thereof.

10. The structure of the signal adapter according to claim 7, wherein an inner diameter of said hollow resilient element become narrower gradually towards center thereof.

11. The structure of the signal adapter according to claim 7, wherein said adapter is comprised of a common-axle cable adapter.

* * * * *